US006098554A

United States Patent [19]

Orii et al.

[11] Patent Number: 6,098,554

[45] Date of Patent: Aug. 8, 2000

[54] EMBROIDERY STITCH DATA PRODUCING DEVICE

[75] Inventors: Akira Orii; Takeshi Kongo; Haruhiko Tanaka; Takayuki Kawasato, all of Hachioji, Japan

[73] Assignee: Janome Sewing Machine Co., Ltd., Tokyo, Japan

[21] Appl. No.: 09/130,088

[22] Filed: Aug. 7, 1998

[51] Int. Cl.[7] ..... D05C 5/06

[52] U.S. Cl. ..... 112/102.5; 700/138

[58] Field of Search ..... 112/102.5, 470.04, 112/470.06, 475.19, 445; 364/470.09, 470.07, 470.08; 700/138

[56] References Cited

U.S. PATENT DOCUMENTS 5,184,560 2/1993 Asano ..... 112/316 X 5,474,000 12/1995 Mizuno et al. ..... 112/102.5

5,740,057 4/1998 Futamura ..... 364/470.09

5,911,182 6/1999 Uyama et al. ..... 112/102.5

*Primary Examiner*—Peter Nerbun

*Attorney, Agent, or Firm*—Nields, Lemack & Dingman

[57] ABSTRACT

An embroidery stitch data producing device is disclosed, which is superior in its operating efficiency and is effectively operated to produce the stitch data for forming the stitches of an image to be embroidered, wherein the device is adapted to designate the parts of the image in accordance with the embroidering conditions including thread colors and other elements and being optionally determined. The designated parts of the image may be divided into a plurality of groups in dependence upon the determined embroidering conditions, and each of the groups are dealt with as a single unit. The stitch data are produced for each of the units in accordance with the determined embroidering conditions.

14 Claims, 6 Drawing Sheets

| Blocks | Thread colors/stitch types | Groups of blocks |
|---|---|---|
| Roof 80 | Red/horizontal | A |
| Wall 81 | Blue/oblique | B |
| Window 82 | Yellow/cross | C |
| Window 83 | Yellow/cross | |
| Outlines 90~95 | Black/zigzag/2mm | D |
| Outlines 96~100 | Blue/straight/2mm | E |

EMBROIDERY STITCH DATA PRODUCING DEVICE

BACKGROUND OF THE INVENTION AND RELATED ART STATEMENT

The invention relates to a device for producing embroidery stitch data to be used to form embroidery stitches particularly by means of a computerized sewing machine.

It has been of usual practice that the maker of the embroidery stitch data producing device makes up and supplies the embroidery stitch data to the user so that the user may use such embroidery stitch data with a sewing machine capable of producing embroidery stitches or with an embroidering machine.

However it has become more conspicuous that the user himself or herself desires to make images as he or she pleases to represent the images in the embroidery stitches. Actually a device is now on sale in the market, which is provided with an image sensor to read the original image depicted on a paper by the user to thereby make the embroidery stitch data therefrom.

It is, however, difficult for such embroidery data producing device now on sale to produce the embroidery stitch data which may make the stitches of the image with a minimum number of thread changing times. For example, in case that the embroidery stitch data are produced for stitching a plurality of parts of the image with many thread colors without changing the thread during stitching at least one part, the user is required to make the original image per each of the parts to be read in by means of the scanner.

The present invention has been provided to eliminate such a troublesome work to be performed by the user.

SUMMARY OF THE INVENTION

The embroidery stitch data producing device of the invention substantially comprises means for giving an image; first designating means for designating stitch conditions for the given image; second designating means for designating the parts of the image to be embroidered in accordance with the designated stitch conditions; stitch data producing means for producing the stitch data in accordance with the designated stitch conditions for stitching the parts of the given image; and memory for storing therein the stitch data as the latter are produced.

The image giving means may be typically composed of a memory such as CD-ROM or the like and a device for reading the data stored in the memory. This means may be CAD or the like for giving the data, or an image scanner for reading an original image to be stitched.

The stitch conditions may include the colors of threads for stitching the inputted image and the stitch types including zigzag stitches, cross stitches and so on. Further the stitch length, the materials of threads and the thickness of threads may be designated.

The parts of the image to be embroidered may be designated with the stitch conditions. By the parts of the image we typically mean the blocks defined by the outlines of the image and the areas enclosed by the outlines. A single block or a plurality of blocks may be designated. The entire blocks may be designated at one time.

The stitch data producing means may produce the stitch data in accordance with the designated stitch conditions for stitching the designated parts of the image. It is desirable that if a plurality of parts are designated with a same stitch condition, the stitch data will be produced in a single unit so that the plurality of parts may be stitched in succession. According to the invention, if a same thread color is designated to a plurality of parts in a single unit, it may reduce the number of thread changing times to a minimum. In this case, if the other stitch condition is different, the designated plurality of parts may be automatically dealt with as a single unit, provided that the thread color is the same.

The produced stitch data are stored in a memory such as a memory card so as to be used for embroidery stitching. It is desirable to use the stitch data in connection with the stitch conditions. For example, the thread color connected to the stitch data may be indicated to the user at the time of actual stitching.

Further it is desirable that the parts or blocks of the image once designated may be partly deleted, or a new block or blocks may be added to the parts designated as a single unit, thereby to increase the operation efficiency.

Further it is desirable that at least the initial or last stitch data in each of the designated blocks, which are independent from one another, include the stitch data for forming finish or loose-preventing stitches even if the designated blocks are dealt with as a single unit since the designated blocks may include a block or blocks located far from the others.

DETAILED DESCRIPTION OF PREFERRED EMBODIMENT

The preferred embodiment of the invention will now be described in reference to the attached drawings.

Figure 1:
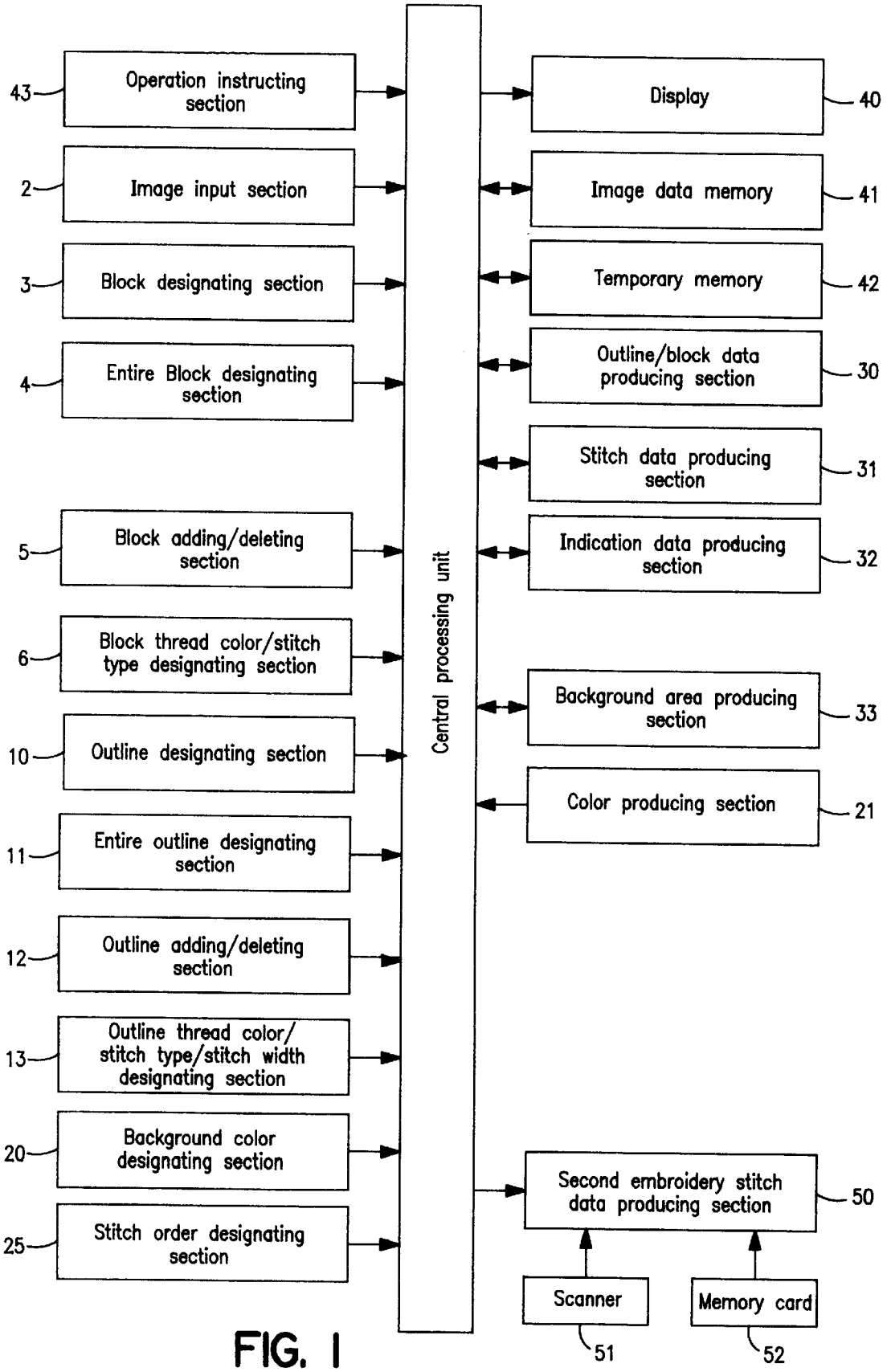
FIG. 1 is a detailed block diagram showing the functions of an embodiment of the invention.
Figure 5:
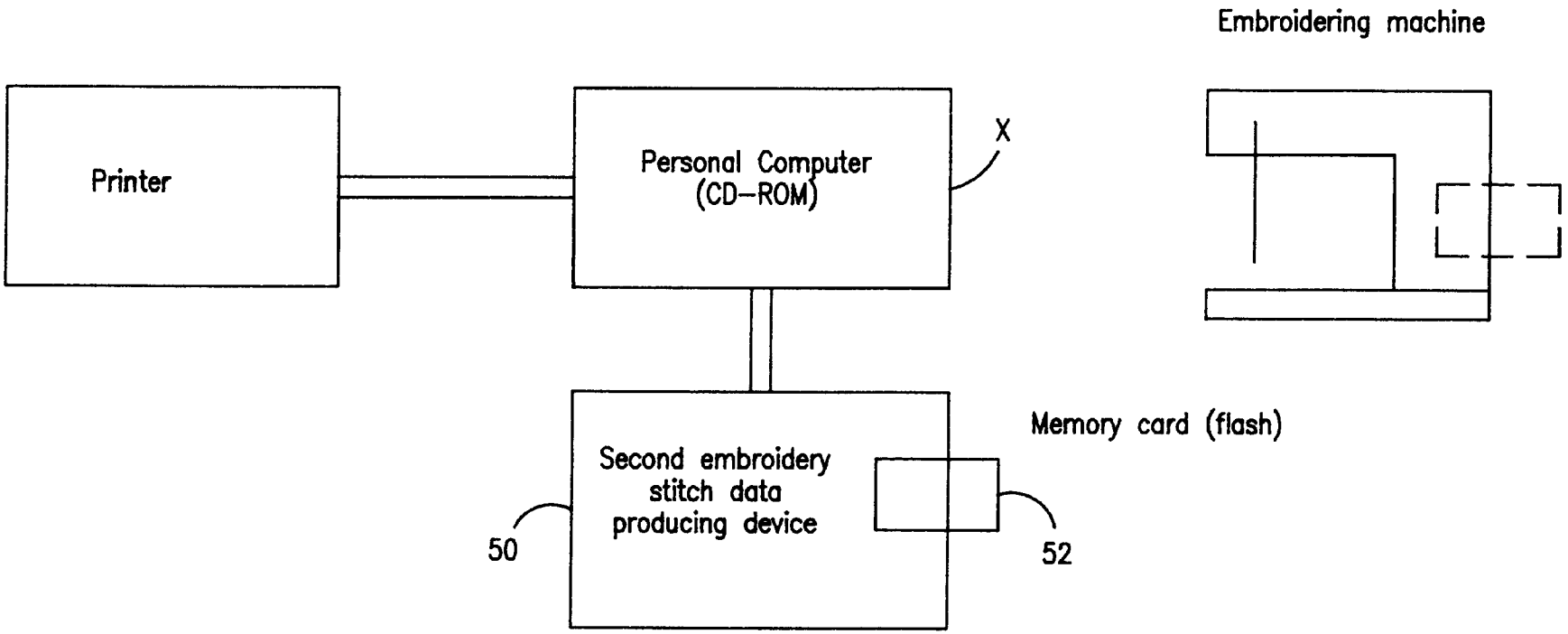
FIG. 5 is a block diagram showing a system of the embroidery data producing device according to the embodiment of the invention including peripheral apparatuses to be used in connection with the device.

FIG. 5 shows the system of the embroidery data producing device X according to the invention including peripheral apparatuses to be used in connection with the device. In this system, the embroidery data producing device X comprises a personal computer having a memory such as a CD-ROM or the like having specific programs stored therein. The embroidery data producing device X is adapted to be connected to a second embroidery data producing device 50 which may be obtained in the market. As shown in FIG. 1, the second embroidery data producing device 50 has a scanner 51 for reading an original image thereat to make stitch data from the image to be stored in a memory card 52. This function of the second embroidery stitch data producing device 50, particularly the function of storing the stitch data as produced into the memory card 52, is utilized in the embroidery data producing device X. It is, of course, possible to provide this function in the embroidery data producing device X itself.

The memory card 52 as having the stitch data stored therein is adapted to be attached to an embroidery stitching sewing machine to make the embroidery stitches.

The embroidery data producing device X has a printer connected thereto, which is operated to print out the stitches which may be produced by means of the stitch data stored in the memory card for confirmation prior to actual stitching.

Figure 2:
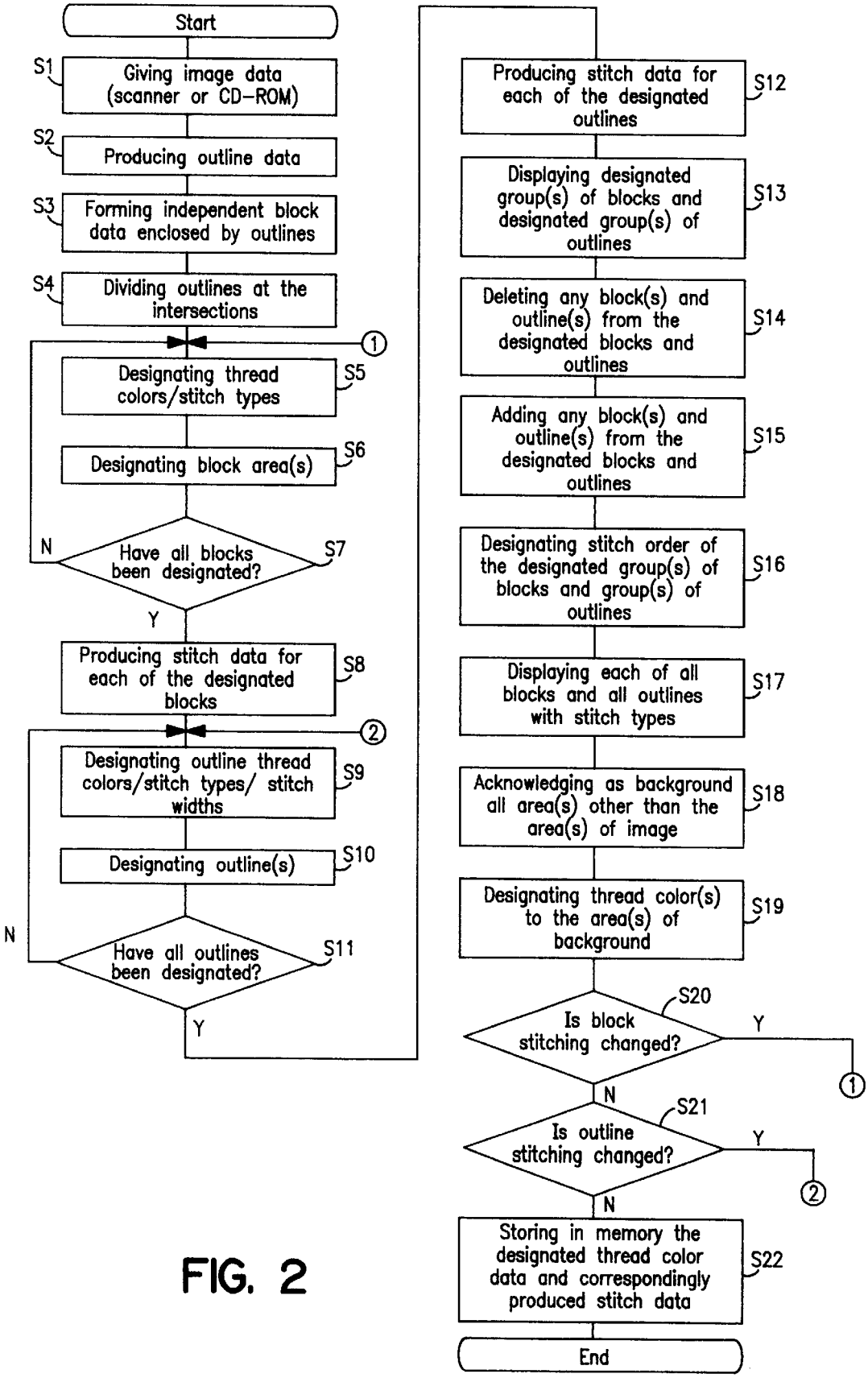
FIG. 2 is a flow chart showing the operation sequences of the embodiment of the invention.

FIG. 1 shows the details of the embroidery data producing device X in the form of blocks, that is, a personal computer comprising various software. FIG. 2 shows a flow chart indicating the sequence of operation steps of the device.

Now in reference to FIGS. 1 and 2, a central processing unit 1 is a capital control section which is operated in response to the instructions from an operation instructing section 43 to control various functions. An image input section 2 is provided to input the image data in the form of bit-map data into the memory such as CD or FD thereof. This may be replaced by the scanner 51 as shown in FIG. 2. The image data may be previously stored in an image data memory 41.

The image data read out from the image input section 2 or the image data memory 41 are stored in a temporary memory 42 and then converted into outline data and block data by an outline/block data producing section 30 (Steps S 1,2,3). If the image representing the configuration of a house as shown in FIG. 3 is inputted, the image is defined by the outlines 90~100 and by the blocks 80~83 enclosed by the outlines in the method as is generally known.

Figure 3:
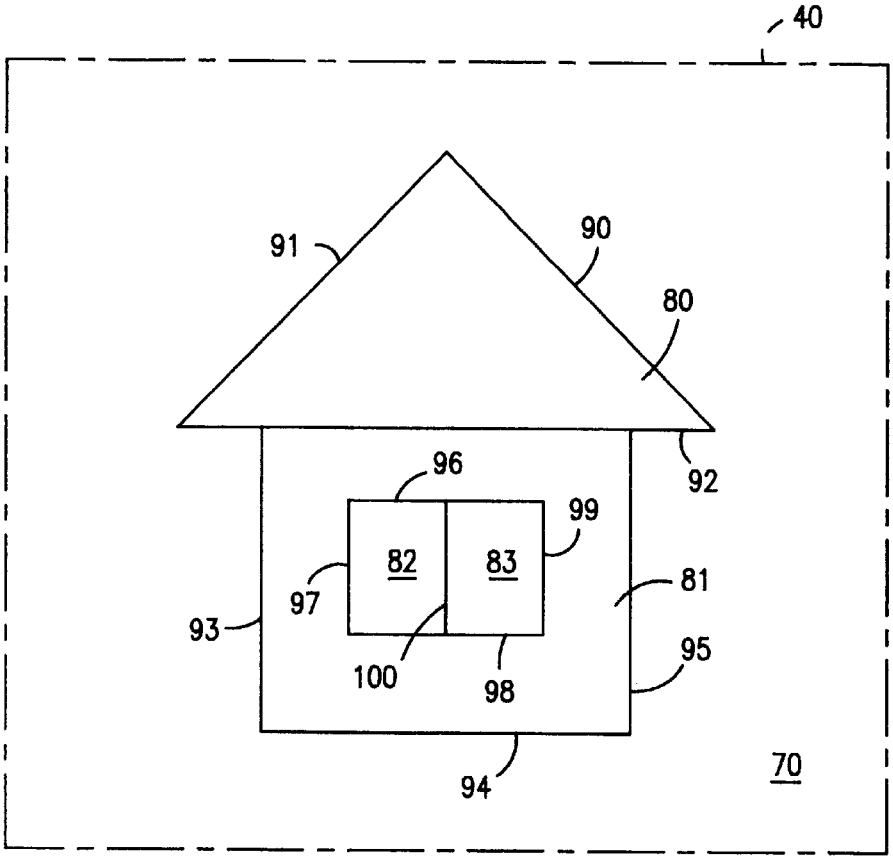
FIG. 3 is an explanatory representation of the embodiment of the invention showing an image divided into blocks enclosed by outlines to be sequentially stitched.

The outlines 90~100 are divided at the intersections as shown in FIG. 3 (Step S4).

The image data including the data for the outlines and blocks are stored in the temporary memory 42 and simultaneously indicated at the display 40 in the manner as shown in FIG. 3.

Subsequently the user may determine the embroidering conditions as to the thread colors, the types of stitches of the outlines and the blocks while looking at the image indicated at the display 40. At first, a block thread color/stitch type designating section 6 is operated to designate the block thread colors and the stitch types (Step S5). Particularly the thread colors and the stitch types are optionally and simultaneously selected from the predetermined colors such as red, blue, yellow and so on, and the predetermined stitch types such as horizontal stitches, vertical stitches, inclined stitches, cross stitches and so on which have the colors as mentioned respectively.

After the thread color and the stitch type have been selected by operation of the block thread color/stitch type designating section 6, a block designating section 3 is operated to select the blocks to which the selected stitch types having the selected thread colors are applied (Step S6). As shown in FIG. 3, the blocks 80,81,82,83 are optionally designated to have the selected stitch types of selected colors applied thereto respectively. The blocks thus designated are each regarded and dealt with as so many units. More particularly, provided that the image of house as shown in FIG. 3 is stitched with a plurality of stitch colors, the productions of stitch types and accordingly of the stitch colors are regarded and dealt with as being occurred in so many units. This will enable the user to accomplish the embroidering operation with a minimum number of times of exchanging the stitch thread as required during the embroidering operation.

FIG. 3 further shows a table by way of example indicating the relations between the embroidering conditions and the designate blocks. In the table, the blocks 82 and 83 are designated continuously with the same conditions, and therefore dealt with one block group C.

When all of the blocks have been designated by operation of the block thread color/stitch type designating section 6 (Step S7), the stitch data will be produced for the designated blocks A, B and C respectively (Step S8). The stitch data as produced will include the stitch data for forming the initial and/or last finish (or loose-preventing ) stitches for each of the blocks. If the a first block and a second block are continuous, the initial finish stitch data may be not required for the second block.

The stitch data may be produced by a stitch data producing section 31. The stitch data as produced are simultaneously processed by an indication data producing section 32 so as to be indicated at the display 40 as the indication data.

In addition to the block designating section 3, an entire block designating section 4 and a block adding/deleting section 5 are provided to increase the operation efficiency of the illustrated device. The entire block designating section 4 may be operated to designate all of the blocks at one time. In this case, all the blocks will be stitched with one designated stitch type, and accordingly of one designated thread color without requirement of designating the blocks one after another.

The block adding/deleting section 5 may be operated to add a new block or blocks, or delete any block or blocks to and from the once designated block group. It is, therefore, possible that the entire block designating section 4 is operated first to designate all of the blocks, and then the block adding/deleting section 5 is operated to add or delete any block or blocks to and from the first designated entire blocks.

Subsequently the user may determine the embroidering conditions including the colors, the stitch types and the stitch widths of the image outlines while looking at the image indicated at the display 40. More particularly an outline color/stitch type/stitch width designating section is operated to designate the thread colors, the stitch types and the stitch widths of the image outlines (Step S9). The thread colors may be optionally selected, for example, from red, blue, yellow and so on. The stitch types may be optionally selected, for example, from zigzag stitches, straight stitches and so on. The stitch widths may be optionally selected, for example, from 2 mm, 3 mm and so on.

Subsequently an outline designating section 10 is operated to designate the outlines of the image to which the thread colors, the stitch types and the stitch widths are applied (Step S10). More particularly as shown in FIG. 3, for example, such outlines are selected from the outlines 90~100 of the image. The selected group or groups of outlines may be dealt with as a single unit, and the stitch data are produced in a single unit, and the embroider stitching is conducted in a single unit, that is, in succession. It is, therefore, apparent that the number of thread changing times may be reduced to a minimum.

In the table in FIG. 3, the outlines 90~95 are designated with black thread/zigzag stitches/stitch width 2 mm while the outlines 96~100 are designated with blue thread/straight stitches/stitch width 2 mm. Therefore, the group of outlines 90~95 and the group of outlines 96~100 are dealt with as so many units, that is, two units D and E.

After all of the outlines have been designated (Step S11), the stitch data are produced for the outline groups D and E respectively in accordance with the designations as shown in FIG. 3 (Step S12). In case the outlines are separated from each other, the stitch data as are produced will include the stitch data for forming at least the initial or last finish or loose-preventing stitches for the respective separated outlines.

The stitch data are produced by the stitch data producing section 31 and simultaneously the indicating data are produced by the indicating data producing section 32 in accordance with the stitch data. The indicating data are indicated at the display 40.

In addition to the outline designating section 10, this embodiment has an entire outline designating section 11 and an outline adding/deleting section 12 provided therewith for increasing the operation efficiency of the device. The entire outline designating section 11 is operated to designate the entire outlines when all blocks are stitched with a same color, a same stitch type and a same stitch width. In this case, it is not required to designate each of the outlines one after another.

The outline adding/deleting section 12 is operated to optionally add a new outline or outlines to the group of outlines which have been designated, or to optionally delete one or more outlines from the group of outlines which have been designated. It will be convenient to use the outline adding/deleting section 12 after the entire outline designating section 11 has been operated.

When the blocks and the outlines are designated in accordance with the embroidery conditions as mentioned above, the designated group of blocks and the designated group of outlines are indicated at the display 40 (Step S13). At this step, it is further possible to optionally add or delete a block or blocks and/or an outline or outlines to and from the group of blocks and/or the group of outlines which have been designated (Steps S14, S15).

As described above, according to the embodiment, the blocks and the outlines are designated by the different sections respectively, and will not be stitched in succession as a single unit if the blocks and the outlines are designated with a same thread color or another embroidery condition.

This embodiment has been described as having the group of blocks and the group of outlines firstly designated with the same embroidery conditions, and then optionally re-designated with manual operations by the user. It is, however, possible to automatically divide the blocks with discrimination of the thread cookers as designated to the blocks and the outlines. In this case, it is desirable that the designated blocks and outlines should not be dealt with as a single unit even if the blocks and outlines are stitched with a same thread color.

The stitching order of the group of blocks and the group of outlines are determined by operation of a stitch order designating section 25, wherein the blocks may be firstly stitched and subsequently the outlines may be stitched and vice versa. Further the stitching order of the blocks and the outlines may be optionally determined (Step S16).

All of the blocks and outlines as designated are indicated at the display 40 so that the blocks and outlines may be acknowledged by the user (Step S17).

According to the embodiment of the invention, the color or colors of the background of the image may be designated and displayed, or printed out. A background area producing section 33 is operated, in response to operation of a background color designating section 20 which is adapted to designate the area of the background of the block(s) and the outline(s), to define the background area 70 (Step S18) so that the designated color may be displayed in the background area 70 (Step S19). Thus the user may confirm the color(s) of the image to be embroidered and the color(s) of the background of the image.

The background color may be selected from predetermine ones. A color producing section 21 is provided to enable the user to optionally produce desired colors including a color which is identical similar with the color of the work to be stitched.

If the embroider conditions for the blocks and outlines are to be not changed (Steps S20,21), the produced stitch data and thread color data are stored in a memory card 52 (Step S22). As shown in FIG. 5, the memory card 52 is detachably attached to an embroidering machine which is operated under control of the stitch data and the color data to form color stitches on the work to be stitched. Since the stitch data are divided into the group of blocks and the group of outlines in accordance with the embroidery conditions as designated, the number of thread changing times may be reduced to a minimum during the embroidery stitching.

Figure 4A:
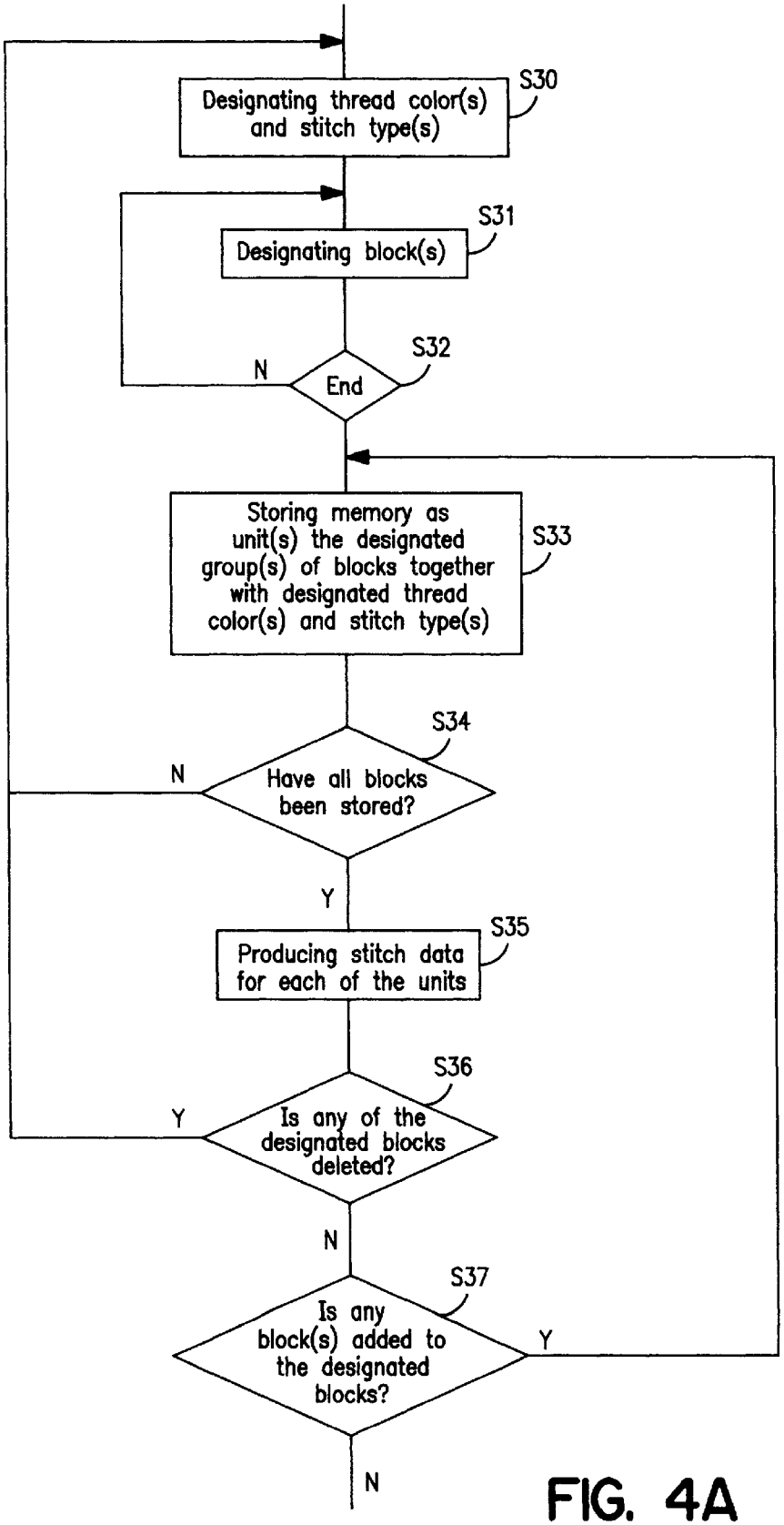
FIG. 4A is a flow chart showing the operations for setting the embroidery conditions and designating the blocks of the image to be stitched according to the embodiment of the invention.

The operations of block designations at steps S5 to S8 and steps S14 and S15 FIG. 2 will now be described in reference to FIG. 4A.

When the block thread color/stitch type designating section 6 is operated to designate the embroidery conditions of block thread color and stitch type (Step S30), the block designating section 3 is operated to designate the block of the embroidery conditions (Step S31). When the designation by the block designating section 3 is finished (Step S32), the designated group of blocks is temporally stored together with the thread color and the stitch type (Step S33). When the designation of all blocks is finished with repetition of the same operations (Step S34), the stitch data are produced corresponding to the groups of blocks respectively (Step S35).

If the block adding/deleting section 5 is operated to delete any embroidery conditions of a block or blocks from the already designated embroidery conditions of blocks, the step is returned to the step S30, where the already designated embroidery conditions of blocks are so reset (Step S36). On the other hand, if the section 5 is operated to add any embroidery conditions of a block or blocks to the already designated embroidery conditions of blocks, the step is returned to the step S33, where the already designated embroidery conditions of blocks are so reset, and then the stitch data are produced for the finally designated embroidery conditions of the groups of blocks (Step S37).

Figure 4B:
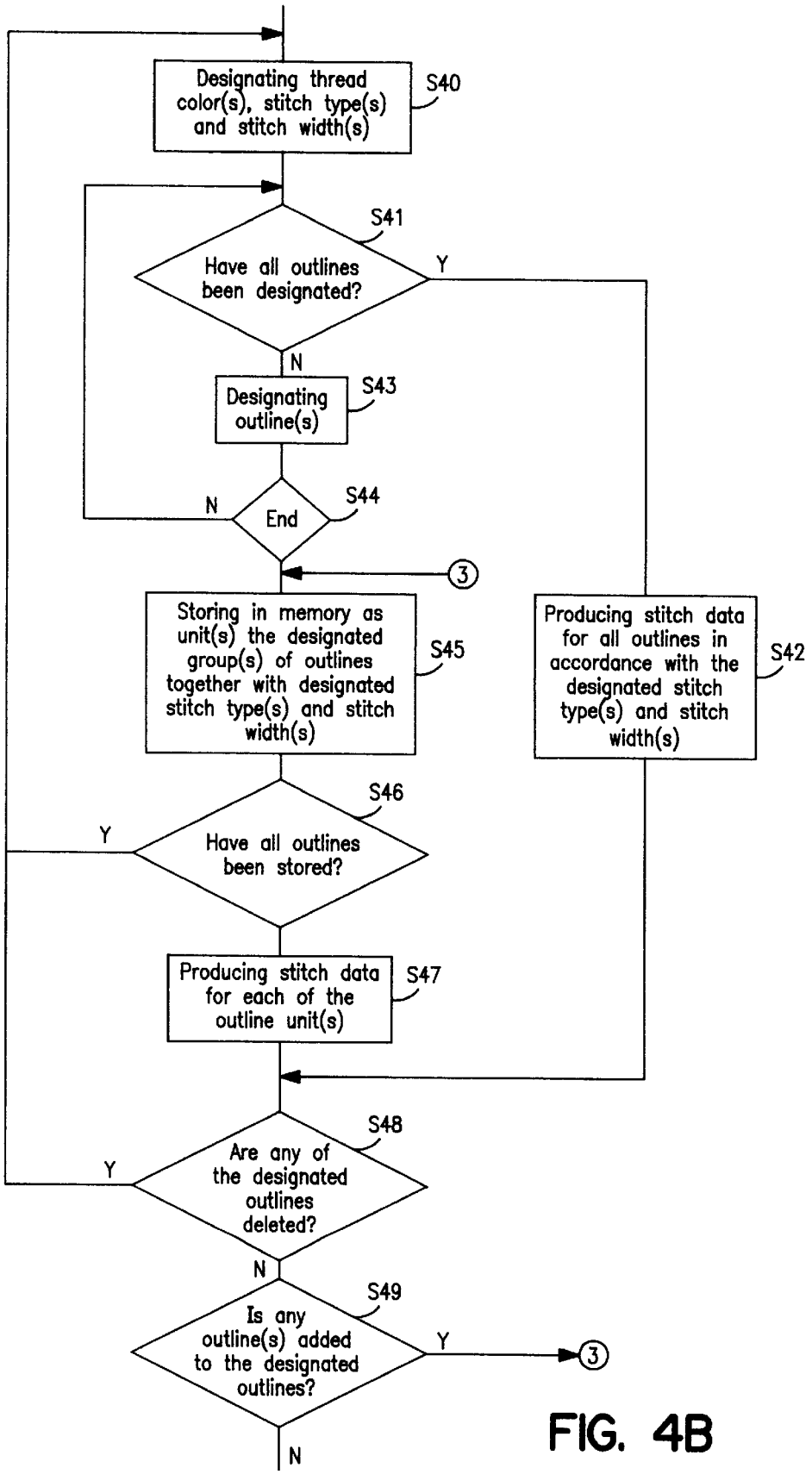
FIG. 4B s a flow chart showing the operations for setting the embroidery conditions and designating the outlines of the image to be stitched according to the embodiment of the invention.

The operations of outline designations at steps S9 to S12 and steps S14 and S15 in FIG. 2 will now be described in reference to FIG. 4B.

The thread colors, stitch types and stitch widths are designated by operation of an outline thread color/stitch type/stitch width designating section 13 (Step S40). In case, the entire outline designating section 11 is operated to designate the entire outlines (Step S41), the stitch data are produced in accordance with the stitch type and the stitch width designated to the entire outlines (Step S42).

In case, entire outlines are not designated at one time by operation of the entire outline designating section 11, the outline designating section 10 is operated to designate each of the groups of outlines (Step S43). When the designation of a group of outlines is finished (Step S44), the designated group of outlines is temporarily stored as a single unit together with the designated thread color, stitch type and stitch width (Step S45). The same operation is repeated until all outlines are designated. When the designations of all outlines are finished (Step S46), the stitch data are produced for each of the groups of outlines (Step S47).

If the outline adding/deleting section 12 is operated to delete any embroidery conditions of an outline or outlines from the already designated embroidery conditions of outlines, the step is returned to the step S40, where the already designated embroidery conditions of outlines are so reset (Step S48). On the other hand, if the section 12 is operated to add any embroidery conditions of an outline or outlines to the already designated embroidery conditions of outlines, the step is returned to the step S45, where the already designated embroidery conditions of outlines are so reset, and then the stitch data are produced for the finally designated embroidery conditions of the groups of outlines (Step S49).

Thus, according to the embodiment of the invention, a same embroidery condition of blocks and outlines may be designated by a single operation, and therefore, the operating efficiency is so increased. Further as each of the groups into which the blocks and outlines are divided may be dealt with as a single unit and the corresponding stitch data are produced, the thread color need not be changed during stitching the unit, and therefore, the number of thread changing times may be reduced to a minimum until a desired image is stitched up.

As is apparent from the above description, the embroidery stitch data producing device of the invention is superior in the operating efficiency as well as in the effective production of stitch data for forming the embroidery stitches. Further the entire disclosure of Japanese Patent Applications No. 9-252638 filed on Sep. 3, 1997, and No. 9-252639 filed on Sep. 3, 1997, including specification, claims and summary are incorporated herein by reference in their entirety.

What is claimed is:

1. An embroidery stitch data producing device comprising:

means for giving an image;

first designating means for designating stitch conditions for said given image;

second designating means for designating the parts of said image to be embroidered in accordance with said designated stitch conditions;

means for deleting one or more of said designated parts of said image;

means for adding one or more parts to said designated parts of said image;

stitch data producing means for producing the stitch data in accordance with said designated stitch conditions for stitching said designated and/or added parts of said given image; and memory for storing therein said stitch data as the latter are produced.

2. The device as defined in claim 1, wherein said stitch data producing means is adapted to produce the stitch data for stitching as a single unit each of said designated parts of said image to which different stitch conditions are designated.

3. The device as defined in claim 1, wherein said stitch conditions include at least one of stitch types, stitch forming directions and thread colors.

4. The device as defined in claim 3, wherein said stitch conditions include said thread colors, and wherein said stitch data producing means is adapted to produce the stitch data for stitching as a single unit one or more of said designated parts of said image to which a same thread color is designated.

5. The device as defined in claim 1, further comprising memory means for storing therein said stitch conditions and said stitch data in combination, said stitch data being produced in accordance with said stitch conditions.

6. An embroidery stitch data producing device comprising:

means for giving an image which is composed of a plurality of blocks;

first designating means for designating thread colors and stitch types for embroidering said blocks of said image;

second designating means for designating the blocks of said image to be embroidered with said designated thread colors and stitch types;

means for deleting one or more blocks from said designated blocks;

means for adding one or more blocks to said designated blocks;

stitch data producing means for producing the stitch data for stitching said designated and/or added blocks of said given image as one or more units in dependence upon the colors and/or stitch types designated to said blocks of said image; and memory for storing therein said thread colors and said stitch data in combination, said stitch data being produced in accordance with said designated thread colors.

7. An embroidery stitch data producing device comprising:

means for giving an image which is composed of a plurality of blocks;

thread color designating means for designating thread colors to said blocks of said image;

block designating means for designating the blocks of said image to be embroidered with said designated thread colors;

means for deleting one or more blocks from said designated blocks;

means for adding one or more blocks to said designated blocks;

stitch data producing means for producing the stitch data for stitching said designated and/or added blocks of said image as one or more units in dependence upon the color or colors designated to said blocks of said image; and memory for storing therein said thread colors and said stitch data in combination, said stitch data being produced in accordance with said designated thread colors.

8. The device as defined in claim 6, wherein said blocks of said image are enclosed by outlines, and said image is composed of said blocks and said outlines.

9. The device as defined in claim 6, wherein said stitch data producing means is adapted to produce the stitch data including stitch data for forming finish stitches or loose-preventing stitches at least at the initial or last stitching position in each of said blocks.

10. An embroidery stitch data producing device comprising:

means for giving an image which is composed of a plurality of outlines;

first designating means for designating thread colors and stitch types to be formed within said outlines of said image;

second designating means for designating the outlines of said image to be embroidered with said designated thread colors and said stitch types;

means for deleting one or more outlines from said designated outlines;

means for adding one or more outlines to each unit of said designated outlines;

stitch data producing means for producing the stitch data for stitching said designated and/or added outlines of said image as one or more units in dependence upon the thread color or colors and/or stitch types designated to said outlines of said image; and memory for storing therein said thread colors and said stitch data in combination, said stitch data being produced in accordance with said designated thread colors.

11. An embroidery stitch data producing device comprising:

means for giving an image which is composed of a plurality of outlines;

first designating means for designating thread colors to be formed within said outlines of said image;

second designating means for designating the outlines of said image to be embroidered with said designated thread colors;

means for deleting one or more outlines from said designated outlines;

means for adding one or more outlines to each unit of said designated outlines;

stitch data producing means for producing the stitch data for stitching said designated and/or added outlines of said image as one or more units in dependence upon the thread color or colors designated to said outlines of said image; and memory for storing therein said thread colors and said stitch data in combination, said stitch data being produced in accordance with said designated thread colors.

12. The device as defined in claim 10, wherein said blocks are defined by said outlines and said image is composed of said blocks and said outlines.

13. The device as defined in claim 10, wherein said stitch data producing means is adapted to produce the stitch data including stitch data for forming finish stitches or loose-preventing stitches at least at the initial or last stitching position of an outline which is independent or isolated from the other outlines.

14. Memory means having programs stored therein for enabling a computer to implement the steps comprising:

reading image data of an image to be stitched, said image having parts;

inputting conditions for stitching said image;

designating and deleting and adding said parts of said image in accordance with said stitching conditions;

producing stitch data in accordance with said stitching conditions for stitching said designated parts of said image; and storing therein said stitch data as are produced.

* * * * *